US010391535B2

(12) United States Patent
Shulkin et al.

(10) Patent No.: US 10,391,535 B2
(45) Date of Patent: Aug. 27, 2019

(54) PROCESS FOR FORMING ALUMINUM ALLOY PARTS WITH TAILORED MECHANICAL PROPERTIES

(71) Applicant: Magna International Inc., Aurora (CA)

(72) Inventors: Boris Shulkin, West Bloomfield, MI (US); Maximilian Amtmann, Brampton (CA); William A. Kokosza, Windsor (CA); Aldo Van Gelder, Newmarket (CA)

(73) Assignee: Magna International Inc., Aurora (CA)

( * ) Notice: Subject to any disclaimer, the term of this patent is extended or adjusted under 35 U.S.C. 154(b) by 643 days.

(21) Appl. No.: 14/904,513

(22) PCT Filed: Jul. 8, 2014

(86) PCT No.: PCT/CA2014/000567
§ 371 (c)(1),
(2) Date: Jan. 12, 2016

(87) PCT Pub. No.: WO2015/003253
PCT Pub. Date: Jan. 15, 2015

(65) Prior Publication Data

US 2016/0193643 A1 Jul. 7, 2016

Related U.S. Application Data

(60) Provisional application No. 61/845,514, filed on Jul. 12, 2013.

(51) Int. Cl.

| | |
|---|---|
| ***C22F 1/04*** | (2006.01) |
| ***B21D 11/20*** | (2006.01) |
| ***C21D 1/06*** | (2006.01) |
| ***C21D 1/18*** | (2006.01) |

(52) U.S. Cl.
CPC ..... *B21D 11/20* (2013.01); *C21D 1/06* (2013.01); *C21D 1/18* (2013.01); *C22F 1/04* (2013.01)

(58) Field of Classification Search
None
See application file for complete search history.

(56) References Cited

U.S. PATENT DOCUMENTS

| | | | | |
|---|---|---|---|---|
| 6,033,499 | A * | 3/2000 | Mitra | B21D 11/18 148/688 |
| 6,550,302 | B1 | 4/2003 | Ghosh | |
| 2004/0189049 | A1 | 9/2004 | Krajewski et al. | |
| 2006/0130941 | A1 | 6/2006 | Litalien et al. | |
| 2006/0182650 | A1* | 8/2006 | Eberl | C22C 21/10 420/532 |
| 2009/0148721 | A1* | 6/2009 | Hibino | B21D 22/20 428/650 |
| 2012/0090371 | A1* | 4/2012 | Radlmayr | B21D 22/20 72/41 |
| 2012/0090742 | A1* | 4/2012 | Smeyers | C22C 21/10 148/701 |
| 2012/0214015 | A1 | 8/2012 | Carsley et al. | |
| 2013/0216790 | A1* | 8/2013 | Smeyers | C22C 21/10 428/174 |

FOREIGN PATENT DOCUMENTS

| | | |
|---|---|---|
| CA | 2182330 | 4/1997 |
| EP | 2415882 A1 * | 2/2012 |
| WO | 2011143757 | 11/2011 |

OTHER PUBLICATIONS

Translation of EP 2415882 (published Feb. 2012) from Espacenet.*
Wang, H. et al., "Warm forming behavior of high strength aluminum alloy AA7075", Transactions of Nonferrous Metals Society of China, vol. 22, pp. 1-7, pubished 2012.*
Canadian Intellectual Property Office; International Search Report and Written Opinion of PCT/CA2014/000567; pp. 1-9; Gatineau, Quebec, Canada Oct. 7, 2014.
Larson, Linus; Warm Sheet Metal Forming with Localized In-Tool Induction Heating; Oct. 2005; pp. 11, 17-19, 26-27, 58; Lund, Sweden.

* cited by examiner

*Primary Examiner* — George Wyszomierski
(74) *Attorney, Agent, or Firm* — Middleton Reutlinger

(57) ABSTRACT

A process for making a shaped-part from a heat-treatable aluminum alloy blank comprises providing the blank in a hardened temper state, for instance the T6 or another suitable temper state. The as-provided blank is subjected to selective heating, such that a first portion of the blank is heated to a predetermined first temperature for a predetermined first length of time and a second portion of the blank is heated to a predetermined second temperature for a predetermined second length of time. The heated blank is then formed into the desired shape of the shaped-part, and is cooled to ambient temperature. The selective heating substantially increases ductility to facilitate forming of the blank into the desired shape of the shaped part, and provides desired mechanical properties within first and second portions of the shaped part corresponding to the first and second portions of the blank.

24 Claims, No Drawings

PROCESS FOR FORMING ALUMINUM ALLOY PARTS WITH TAILORED MECHANICAL PROPERTIES

This PCT patent application claims the benefit of U.S. Provisional Patent Application No. 61/845,514 filed Jul. 12, 2013, entitled "PROCESS FOR FORMING ALUMINUM ALLOY PARTS WITH TAILORED MECHANICAL PROPERTIES", the entire disclosure of the application being considered part of the disclosure of this application and hereby incorporated by reference.

FIELD OF THE INVENTION

The instant invention relates generally to a process for making shaped parts, and more particularly to a process for forming heat-treatable aluminum alloy blanks into shaped parts with tailored mechanical properties.

BACKGROUND OF THE INVENTION

Concern for the environment, as well as the rising cost of energy, has resulted in a push in recent years to develop vehicles that are more fuel-efficient than previous models. Weight reduction has long been identified as an effective way to improve automotive fuel economy, such as for instance by replacing steel with lighter weight materials including aluminum and magnesium alloys. In fact, several parts of the vehicle body and powertrain are already being fabricated from aluminum alloys, including the engine block and heads, the wheels and some body panels. The alloys of aluminum that are used in body panel applications tend to be the more easily formable, but also lower strength, 5xxx series alloy. Unfortunately, structural components such as the B-pillar require the use of higher strength materials in order to satisfy roof crush and side impact safety standards.

High strength aluminum alloys are a viable alternative to the use of high strength steel in automotive structural components. In particular, heat treatable aluminum alloys such as the 2xxx, 6xxx, 7xxx and 8xxx series alloys can be hardened using an appropriate thermal treatment and artificial aging process. Due to the poor formability of such alloys in their hardened temper states, such as for instance the T6 temper state, it is common to provide a blank for forming a part in softer temper states, such as for instance T4. The blank is formed into the desired shape of the part, which is then subjected to thermal treatment and artificial aging to achieve desired mechanical properties. Unfortunately, this approach results in production times that could be impractically long, since the thermal treatment and aging processes occur over periods of time ranging from several minutes to several hours. A further problem with this approach is that warping of the shaped part may occur during the thermal treatment and aging steps, necessitating additional steps to correct the shape. As such, this approach may not be well suited to the automotive manufacturing industry, or to other high-volume applications that require the production of a large number of parts on a short time-scale.

In the article "Warm forming behavior of high strength aluminum alloy AA7075," Trans. Nonferrous Met. Soc. China 22(2012) 1-7, Wang et al. discuss the effects of elevated temperatures on the mechanical properties of a specific 7xxx series aluminum alloy. According to Wang et al. a key element of warm forming is the preservation of the high strength temper, although the results that are presented in the article demonstrate that both the yield strength and hardness are lower after forming at a temperature between about 180° C. and 260° C. The authors of this article concluded that, in order to obtain a part without any further heat treatment, the forming temperature should not exceed 220° C. Of course, Wang et al. subjected the aluminum alloy to heat treatment lasting up to 300 s, which translates into only about twelve heating cycles per hour and is therefore impractical for use in high-volume applications.

Another study has shown that warm forming a Cu-containing AA7075 type alloy at 175° C. for one or two minutes has almost no impact on strength, and that a slight increase to 200° C. reduces the strength by about 50 MPa. This study concluded that during a common 5-step paint-bake cycle the mechanical properties of the component become uniform on a high level. Unfortunately, even with these relatively short heating times, lasting only one or two minutes, the resulting production rates are still too low to be very useful in high-volume applications such as the automotive industry.

In some applications, including the fabrication of structural components that have predetermined crush zones, it is desirable to be able to produce a part that has non-uniform mechanical properties throughout. For instance, it is advantageous to form a B-pillar with an upper end that is characterized by high mechanical strength and a lower end that is characterized by relatively lower mechanical strength. During a collision, some of the force of the impact is absorbed when the lower end of the B-pillar deforms, resulting in improved protection for the occupants of the vehicle. Unfortunately, the processes that are currently being used to form shaped parts from aluminum alloy blanks in hardened temper states do not support the tailoring of mechanical properties in this way.

It would therefore be desirable to provide a process that overcomes at least some of the above-mentioned limitations and disadvantages of the prior art.

SUMMARY OF THE INVENTION

According to an aspect of at least one embodiment of the instant invention, a process is disclosed for making a shaped-part from a heat-treatable aluminum alloy blank, comprising: providing a heat-treatable aluminum alloy blank in a hardened temper state; heating a first portion of the blank to a predetermined first temperature of between about 150° C. and about 300° C. for a predetermined first length of time lasting less than about 40 seconds, such as for instance between about 5 seconds and about 40 seconds; heating a second portion of the blank to a predetermined second temperature of between about 150° C. and about 300° C. for a predetermined second length of time lasting less than about 40 seconds, such as for instance between about 5 seconds and about 40 seconds; and prior to either of the first portion and the second portion cooling to a temperature below about 130° C., forming the blank within the first portion and within the second portion into the shape of the shaped-part.

According to an aspect of at least one embodiment of the instant invention, a process is disclosed for forming a shaped-part from a heat-treatable aluminum alloy blank, comprising: providing a heat-treatable aluminum alloy blank in a hardened temper state; subjecting different portions of the blank to different heating conditions, comprising selectively heating each of the different portions of the blank to a respective predetermined temperature between about 150° C. and about 300° C., the heating of each of the different portions of the blank lasting less than about 40 seconds, such as for instance between about 5 seconds and about 40 seconds; and prior to any of the different portions of the blank cooling to a temperature below about 130° C., forming the blank into the shape of the shaped-part such that the different portions of the blank form corresponding different portions of the shaped-part, the different portions of the shaped-part having different predetermined mechanical properties, wherein the different heating conditions are selected for producing the different predetermined mechanical properties of the different portions of the shaped-part.

According to an aspect of at least one embodiment of the instant invention, a process is disclosed for making a shaped-part from a heat-treatable aluminum alloy blank, comprising: providing an aluminum alloy blank fabricated from one of a 2xxx, 6xxx, 7xxx and 8xxx series aluminum alloy, the blank provided in the T6 temper state; heating a first portion of the blank to a predetermined first temperature of between about 150° C. and about 300° C. for a predetermined first length of time lasting less than about 40 seconds, such as for instance between about 5 seconds and about 40 seconds; heating a second portion of the blank to a predetermined second temperature of between about 150° C. and about 300° C. for a predetermined second length of time lasting less than about 40 seconds, such as for instance between about 5 seconds and about 40 seconds; and forming the blank into the shape of the shaped-part such that the first portion of the blank forms a corresponding first portion of the shaped-part having predetermined first mechanical properties and the second portion of the blank forms a corresponding second portion of the shaped-part having predetermined second mechanical properties that are different than the predetermined first mechanical properties, wherein the first predetermined mechanical properties and the second predetermined mechanical properties are selected such that both the first portion of the shaped-part and the second portion of the shaped-part are at least one of softer and more ductile than the corresponding first and second portions of the blank as provided.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

In a process for forming a shaped part according to an embodiment of the instant invention, a blank fabricated from a heat-treatable aluminum alloy is provided in a hardened temper state. For instance, the heat-treatable aluminum alloy is selected from the group consisting of 2xxx, 6xxx, 7xxx and 8xxx series aluminum alloys. By way of a specific and non-limiting example, the hardened temper state is the T6 temper state. Optionally, the hardened temper state is the T4, T5 or T7, for instance T7x (e.g., T76 or T79) temper state, or another suitable temper state. As is customary in such forming processes, the shape of the blank has an outer contour that is generally in conformity with the desired shape of the shaped part. For instance, the shaped part is a B-pillar for an automobile and the blank has an outer contour that is generally in conformity with the final shape of the B-pillar.

The as-provided blank is subjected to a selective heating step, during which a first portion of the blank is heated to a predetermined first temperature for a predetermined first length of time and a second portion of the blank is heated to a predetermined second temperature for a predetermined second length of time. In particular, the predetermined first temperature is between about 150° C. and about 300° C. and the predetermined first length of time is less than about 40 seconds, such as for instance between about 5 seconds and about 40 seconds. Similarly, the predetermined second temperature is between about 150° C. and about 300° C. and the predetermined second length of time is less than about 40 seconds, such as for instance between about 5 seconds and about 40 seconds. The blank is then formed into the desired shape of the shaped part, prior to either of the first portion or the second portion cooling to a temperature below about 130° C. During forming, the first portion of the blank forms a corresponding first portion of the shaped part and the second portion of the blank forms a corresponding second portion of the shaped part.

The predetermined first temperature and the predetermined first length of time are selected such that the first portion of the shaped part has predetermined first mechanical properties. Similarly, the predetermined second temperature and the predetermined second length of time are selected such that the second portion of the shaped part has predetermined second mechanical properties. Optionally, the predetermined first length of time is the same as the predetermined second length of time, in which case the predetermined first temperature is different than the predetermined second temperature. Alternatively, the predetermined first length of time is different than the predetermined second length of time, in which case the predetermined first temperature may be either the same as or different than the predetermined second temperature. In general, the product of the predetermined first temperature and the predetermined first length of time is different than the product of the predetermined second temperature and the predetermined second length of time, but this is not strictly a necessary condition. According to an embodiment, the temperature of the aluminum alloy blank within the first portion does not exceed about 230° C. during heating of the first portion and the temperature of the aluminum alloy blank within the second portion does not exceed about 230° C. during heating of the second portion.

The selective heating of the blank may be achieved in any of a number of different ways. Any suitable heating system, or even a combination of different heating systems, may be used to perform the selective heating. For instance, the blank may be heated using an array of infrared lamps, an array of inductive heating coils, a heated fluidized bed, an oven, etc. Optionally, some portions of the blank are protected from being heated, such as for instance by using a heat shield or an active cooling element, during the time that other portions of the blank are being heated. Optionally, only a portion of the blank is inserted into a heating zone, such that other portions of the blank are protected from being heated. Further optionally, at least one portion of the blank is not heated such that a portion of the shaped part corresponding to the at least one portion of the blank has mechanical properties that are substantially the same as those of the as-provided blank. For instance, the at least one portion of the blank that is not heated is a portion that is not shaped during the forming step, and is intended to have high mechanical strength and/or hardness in the final part.

The relative locations of the first portion of the blank and the second portion of the blank depend upon the desired distribution of mechanical properties in the shaped part. The first portion of the blank may be disposed immediately adjacent to the second portion of the blank. Alternatively a third portion of the blank is defined, separating the first portion of the blank from the second portion of the blank. In some applications, the third portion of the blank corresponds to a third portion of the shaped part that has mechanical properties substantially identical to the mechanical properties of the as-provided blank. In other applications, the third portion of the blank corresponds to a third portion of the shaped part that has mechanical properties intermediate the predetermined first mechanical properties and the predetermined second mechanical properties. For instance, the third portion of the blank is a transition region for transitioning between the predetermined first mechanical properties and the predetermined second mechanical properties. In this case, selective heating includes heating the third portion of the blank to a predetermined third temperature for a predetermined third length of time. Alternatively, the third portion of the blank corresponds to a third portion of the shaped part that has mechanical properties intermediate those of the as-provided blank and the first and second mechanical properties.

The forming step is performed, for instance, by disposing the blank between opposing tool halves that are mounted in a press, and then relatively moving the opposing tool halves one toward the other so as to conform the blank against forming surfaces of the opposing tool halves. In a first approach, the selective heating of the blank is performed prior to disposing the blank between the opposing tool halves. In a second approach, the selective heating of the blank is performed at least partially after disposing the blank between the opposing tool halves. For instance, the tool halves optionally include heating inserts for heating the first portion and/or the second portion of the blank during forming. The tool halves do not require any special inserts for cooling the first portion of the blank or the second portion of the blank, and the shaped part is not quenched after the forming step. As such, the shaped part is simply removed from between the tool halves and placed on a rack or on a transport device and allowed to cool to the ambient surrounding temperature. Of course, in this example it has been assumed for simplicity that the tool that is used for forming the shaped part has only two halves. In practice, the tool may be a multi-part tool with more than two parts, and optionally some of the parts may have heating inserts disposed along forming surfaces thereof. Optionally, an insulating material is provided in place of heating inserts, for reducing the rate of cooling within selected portions of the blank during forming.

As noted above, the blank is provided in a hardened temper state, such as for instance the precipitation hardened and artificially aged T6 temper state. The as-provided blank is poorly formable and therefore it is not well suited for being formed into shaped parts. However, the selective heating of the blank substantially increases the ductility of the portions that are heated and facilitates forming. After the shaped part is formed and cooled to ambient temperature, the mechanical properties of the portions of the blank that were selectively heated are different than the mechanical properties of the as-provided blank. In particular, the material within the first and second portions of the shaped part is at least one of softer and more ductile than the material within the corresponding first and second portions of the as-provided blank. Although the T6 temper state has been used as a specific and non-limiting example, it is to be understood that the blank may alternatively be provided in another hardened temper state, such as for instance T4, T5, T7, T7x (e.g., T76 or T79), etc.

Embodiments of the instant invention have been described in terms of a specific and non-limiting example of a process for forming a B-pillar for motor vehicles. It is to be understood that other structural components for motor vehicles may be formed using the processes described herein. Further, the processes described herein may be used to form non-structural components for motor vehicles, as well as components for use in aircraft, marine vehicles and even non-vehicle applications.

While the above description constitutes a plurality of embodiments of the present invention, it will be appreciated that the present invention is susceptible to further modification and change without departing from the fair meaning of the accompanying claims.

What is claimed is:

1. A process for making a shaped-part from a heat-treatable aluminum alloy blank, comprising:

providing a heat-treatable aluminum alloy blank in a hardened temper state;

heating a first portion of the blank to a predetermined first temperature of between about 150° C. and about 300° C. for a predetermined first length of time lasting less than about 40 seconds;

heating a second portion of the blank to a predetermined second temperature of between about 150° C. and about 300° C. for a predetermined second length of time lasting less than about 40 seconds; and prior to either of the first portion and the second portion cooling to a temperature below about 130° C., forming the blank within the first portion and within the second portion into the shape of the shaped-part, wherein the hardened temper state is one of a T4, T5, T6, T7 and T7x temper state.

2. The process according to claim 1 wherein the heat treatable aluminum alloy is selected from the group consisting of 2xxx, 6xxx, 7xxx and 8xxx aluminum alloys.

3. The process according claim 1 wherein the step of forming is performed using a press, and comprises:

disposing the aluminum alloy blank between opposing tool parts that are mounted in the press; and relatively moving the opposing tool parts one toward the other so as to conform the aluminum alloy blank to forming surfaces provided along each of the opposing tool parts.

4. The process according to claim 3 wherein the heating of the first and second portions of the aluminum alloy blank is performed prior to disposing the aluminum alloy blank between the opposing tool parts that are mounted in the press.

5. The process according to claim 4 wherein the first and second portions of the aluminum alloy blank do not undergo further heating during the forming step.

6. The process according to claim 4 comprising performing further heating of the first and second portions of the aluminum alloy blank during the forming step.

7. The process according to claim 3 wherein the heating of the first and second portions of the aluminum alloy blank is performed subsequent to disposing the aluminum alloy blank between the opposing tool parts that are mounted in the press.

8. The process according to claim 1 wherein the temperature of the aluminum alloy blank within the first portion does not exceed about 230° C. during heating of the first portion and wherein the temperature of the aluminum alloy blank within the second portion does not exceed about 230° C. during heating of the second portion.

9. The process according to claim 1 wherein a product of the predetermined first temperature and the predetermined first length of time is different than a product of the predetermined second temperature and the predetermined second length of time.

10. The process according to claim 1 wherein the predetermined first temperature is different than the predetermined second temperature.

11. The process according to claim 1 wherein the predetermined first length of time is different than the predetermined second length of time.

12. The process according to claim 1 wherein a first portion of the shaped-part corresponding to the first portion of the blank has predetermined first mechanical properties and wherein a second portion of the shaped-part corresponding to the second portion of the blank has predetermined second mechanical properties, the predetermined second mechanical properties different than the predetermined first mechanical properties.

13. The process according to claim 12 wherein the predetermined first temperature and the predetermined first length of time are selected to produce the predetermined first mechanical properties and wherein the predetermined second temperature and the predetermined second length of time are selected to produce the predetermined second mechanical properties.

14. The process according to claim 12 wherein both the first portion of the shaped-part and the second portion of the shaped-part are at least one of softer and more ductile than the corresponding first and second portions of the blank as provided.

15. The process according to claim 1 wherein the T7x temper state is one of a T76 and a T79 temper state.

16. A process for forming a shaped-part from a heat-treatable aluminum alloy blank, comprising:

providing a heat-treatable aluminum alloy blank in a hardened temper state;

subjecting different portions of the blank to different heating conditions, comprising selectively heating each of the different portions of the blank to a respective predetermined temperature between about 150° C. and about 300° C., the heating of each of the different portions of the blank lasting less than about 40 seconds; and prior to any of the different portions of the blank cooling to a temperature below about 130° C., forming the blank into the shape of the shaped-part such that the different portions of the blank form corresponding different portions of the shaped-part, the different portions of the shaped-part having different predetermined mechanical properties, wherein the different heating conditions are selected for producing the different predetermined mechanical properties of the different portions of the shaped-part, wherein the hardened temper state is one of a T4, T5, T6, T7 and T7x temper state.

17. The process according to claim 16 wherein the different portions of the blank have substantially the same mechanical properties, prior to subjecting the different portions of the blank to the different heating conditions.

18. The process according to claim 16 wherein all of the different portions of the shaped-part are at least one of softer and more ductile than the corresponding different portions of the blank as provided.

19. The process according to claim 16 wherein the heat treatable aluminum alloy is selected from the group consisting of 2xxx, 6xxx, 7xxx and 8xxx aluminum alloys.

20. The process according to claim 16 wherein the temperature within any of the different portions of the aluminum alloy blank does not exceed about 230° C. during the step of subjecting the different portions of the blank to different heating conditions.

21. The process according to claim 16 wherein the T7x temper state is one of a T76 and a T79 temper state.

22. A process for making a shaped-part from a heat-treatable aluminum alloy blank, comprising:

providing an aluminum alloy blank fabricated from one of a 2xxx, 6xxx, 7xxx and 8xxx series aluminum alloy, the blank provided in one of a T6 and a T7x temper state;

heating a first portion of the blank to a predetermined first temperature of between about 150° C. and about 300° C. for a predetermined first length of time lasting less than about 40 seconds;

heating a second portion of the blank to a predetermined second temperature of between about 150° C. and about 300° C. for a predetermined second length of time lasting less than about 40 seconds; and prior to either of the first portion and the second portion cooling to a temperature below about 130° C., forming the blank into the shape of the shaped-part such that the first portion of the blank forms a corresponding first portion of the shaped-part having predetermined first mechanical properties and the second portion of the blank forms a corresponding second portion of the shaped-part having predetermined second mechanical properties that are different than the predetermined first mechanical properties, wherein the first predetermined mechanical properties and the second predetermined mechanical properties are selected such that both the first portion of the shaped-part and the second portion of the shaped-part are at least one of softer and more ductile than the corresponding first and second portions of the blank as provided.

23. The process according to claim 22 wherein the predetermined first temperature and the predetermined first length of time are selected to produce the predetermined first mechanical properties and the predetermined second temperature and the predetermined second length of time are selected to produce the predetermined second mechanical properties.

24. The process according to claim 22 wherein the T7x temper state is one of a T76 and a T79 temper state.

* * * * *